US008028943B2

(12) United States Patent
Harbs

(10) Patent No.: US 8,028,943 B2
(45) Date of Patent: Oct. 4, 2011

(54) AGITATING BALL MILL

(75) Inventor: Theron Harbs, Pomerode (BR)

(73) Assignee: NETZSCH—Feinmahltechnik GmbH (DE)

( * ) Notice: Subject to any disclaimer, the term of this patent is extended or adjusted under 35 U.S.C. 154(b) by 13 days.

(21) Appl. No.: 12/557,223

(22) Filed: Sep. 10, 2009

(65) Prior Publication Data

US 2010/0127108 A1 May 27, 2010

(30) Foreign Application Priority Data

Nov. 22, 2008 (DE) ..... 10 2008 058 585

(51) Int. Cl.
*B02C 17/16* (2006.01)

(52) U.S. Cl. ..... 241/171; 241/172

(58) Field of Classification Search ..... 241/171, 241/172, 152.2

See application file for complete search history.

(56) References Cited

U.S. PATENT DOCUMENTS 4,534,516 A * 8/1985 Hashizume ..... 241/171
4,967,972 A * 11/1990 Inoue ..... 241/171
5,853,132 A * 12/1998 Tsuji ..... 241/172

FOREIGN PATENT DOCUMENTS

DE 217434 A1 1/1985
DE 4412408 A1 10/1995

* cited by examiner

*Primary Examiner* — Mark Rosenbaum
(74) *Attorney, Agent, or Firm* — St. Onge Steward Johnston & Reens LLC

(57) ABSTRACT

An agitating ball mill includes a comminution vessel surrounding an agitating shaft which is provided with a product inlet and a product outlet, wherein the comminution media located within the comminution vessel is activated through the rotation of the agitating shaft and held back in the comminution chamber by a separating and/or pre-classifying device. For optimum energy and space utilization a pre-crushing device is arranged upstream of the comminution chamber. The pre-crushing device includes either a static or dynamic gap guard.

15 Claims, 4 Drawing Sheets

AGITATING BALL MILL

CROSS-REFERENCE TO RELATED APPLICATIONS

The present application claims priority of German patent application No. 10 2008 058 585.8 filed on Nov. 22, 2008, the content of which is incorporated herein by reference.

FIELD OF THE INVENTION

Agitating ball mill with a comminution vessel surrounding an agitating shaft which is provided with a product inlet and a product outlet, wherein the comminution media present within the comminution vessel is activated through the rotation of the agitating shaft and held back in the comminution chamber by a separating or classifying device.

BACKGROUND OF THE INVENTION

An agitating ball mill of this type is shown in FIG. 1 of DE 44 12 408 A1. This agitating ball mill comprises a double-walled comminution vessel which is suitable for cooling. Within the comminution vessel the agitating shaft arranged coaxially to the comminution vessel is connected with a gearing and a drive. In its lid, the comminution vessel has a comminution stock inlet and, centrally in its base, a comminution stock outlet. The product enters the comminution chamber via the inlet where it is worked through the comminution media present in the comminution chamber. To this end, the comminution discs provided with holes and located on the agitating shaft put the comminution media in motion as a result of which the energy acting from the motor on to the comminution discs is transmitted to the comminution media. The kinetic energy available for this results in the dispersion or comminution of the product introduced in the comminution vessel. Depending on how the agitating ball mill is operated, whether according to the single pass or multiple pass method, the product either in its desired final fineness or as intermediate product finally reaches the area of a pre-classifying stage which holds back in the comminution chamber the comminution media and, if applicable, also products in the corresponding size. In addition to the pre-classifier a separating device can also be provided.

From DD 217 434 B1 a vertically arranged agitating ball mill is known. This agitating ball mill works with an agitating shaft on which a screw-shaped comminution element is fastened. In the inlet area of the mill is located a pre-crushing device connected with the agitating shaft, which consists of a crushing cone and a crushing ring fastened to the comminution vessel wall. The comminution stock or feedstock directly reaches the top of the crushing cone via a screw conveyor and from there into the crushing gap. Following completed pre-crushing the material falls into the comminution vessel in which it is worked by the agitating shaft and the comminution media present in the comminution vessel. The filling level height in the comminution vessel is monitored via a filling level measuring device. This is not possible with horizontally arranged mills and with mills whose comminution chamber is completely utilised. In these cases, the comminution stock reaches the area of the pre-crushing device with the comminution media.

The objective of the invention is to combine a comminution and dispersion device with a pre-crushing device which is largely protected against wear that can be caused by the comminution stock/comminution media mixture.

SUMMARY OF THE INVENTION

The objective is achieved with an agitating ball mill wherein after the product inlet a pre-crushing device is provided which comprises a gap guard to the comminution chamber.

Because of the pressure prevailing in the comminution vessel and the high percentage charge of comminution media in the comminution vessel, comminution media during the operation of the agitating ball mill can reach the gap of the pre-crushing device where they can cause wear or other impediments. Because of this, it is provided in an advantageous configuration of the invention to protect the gap either through a dynamic or static gap guard.

Under certain conditions in the comminution chamber it can be advantageous to arrange the gap guard as a rotating or static part after the pre-crusher.

The effect of the gap guard according to the invention is improved in that a ring element is used here which is connected with the rotor of the pre-crusher. Here, the ring element radially flings off the comminution media in the region of the gap and simultaneously generates a vacuum zone at the end of the gap transition to the comminution chamber as a result of which the product from the comminution zone easily passes over into the comminution chamber.

In a configuration of the invention according to the invention the ring element on the comminution chamber end of the comminution gap comprises a shoulder that can be configured wedge or nose-shaped.

This configuration brings with it the advantage that between the shoulder and the ring element a space can be maintained which corresponds to 2 to 10 times the width of the comminution gap. With expensive design, this spacing can be adapted to the fastening of the ring element, the size of the pre-crushed stock or the comminution media.

According to a further configuration of the invention it can be substantial to the function of the pre-crushing device that the static or dynamic ring element not only ends radially on the comminution gap but overlaps said comminution gap, namely in a ratio of 2 to 10 times the width of the comminution gap.

According to a preferred embodiment the pre-crushing device consists of a rotating part and a stationary part, wherein the rotating part in turn is preferentially in connection with the agitating shaft.

The stationary part of the pre-crushing device is in connection with the comminution vessel. This is an advantage especially when this area of the comminution vessel is cooled. Even the cooling of one of the parts of the pre-crushing device brings about the keeping constant of the product temperature during pre-crushing.

With an advantageous further development of the invention the toothed discs are so arranged that the surfaces of the rotating and the stationary part of the pre-crushing device directed to the comminution chamber simultaneously form the inlet-sided comminution chamber limit.

The gap formed by the stationary and the rotating part of the pre-crushing device is advantageously kept smaller than the diameter of the comminution media present in the comminution chamber. Here, a gap width of 0.2-2 mm is selected. Through the arrangement of additional vanes or the like on the side of the rotating part facing the comminution chamber the inflow of the pre-crushed product parts can be improved and a comminution media congestion in the area of the shear gap avoided or reduced.

In a particular configuration according to the invention either the rotating or also the stationary part of the pre-crushing device can be axially adjustable, as a result of which the gap width before or after the production process can be changed. In a purely mechanical configuration possibility of the invention both the rotating as well as the stationary part of the pre-crushing device are axially adjustable via a thread on the agitating shaft or on the comminution vessel. The corrected working position is fixed via locknuts.

In a further development of the above-mentioned inventive configuration the rotating and/or the stationary part of the pre-crushing device are correctable in their position through electrical or hydraulic actuators. The pistons or electric drives initializable via external command elements thus allow direct intervention in the pre-crushing device and thus also intervention in the fineness of the product fed to the comminution process.

BRIEF DESCRIPTION OF THE DRAWINGS

Exemplary embodiments of the pre-crushing device and the agitating ball mill are evident from the representations described in the following. It shows.

DETAILED DESCRIPTION OF THE INVENTION

Figure 1:
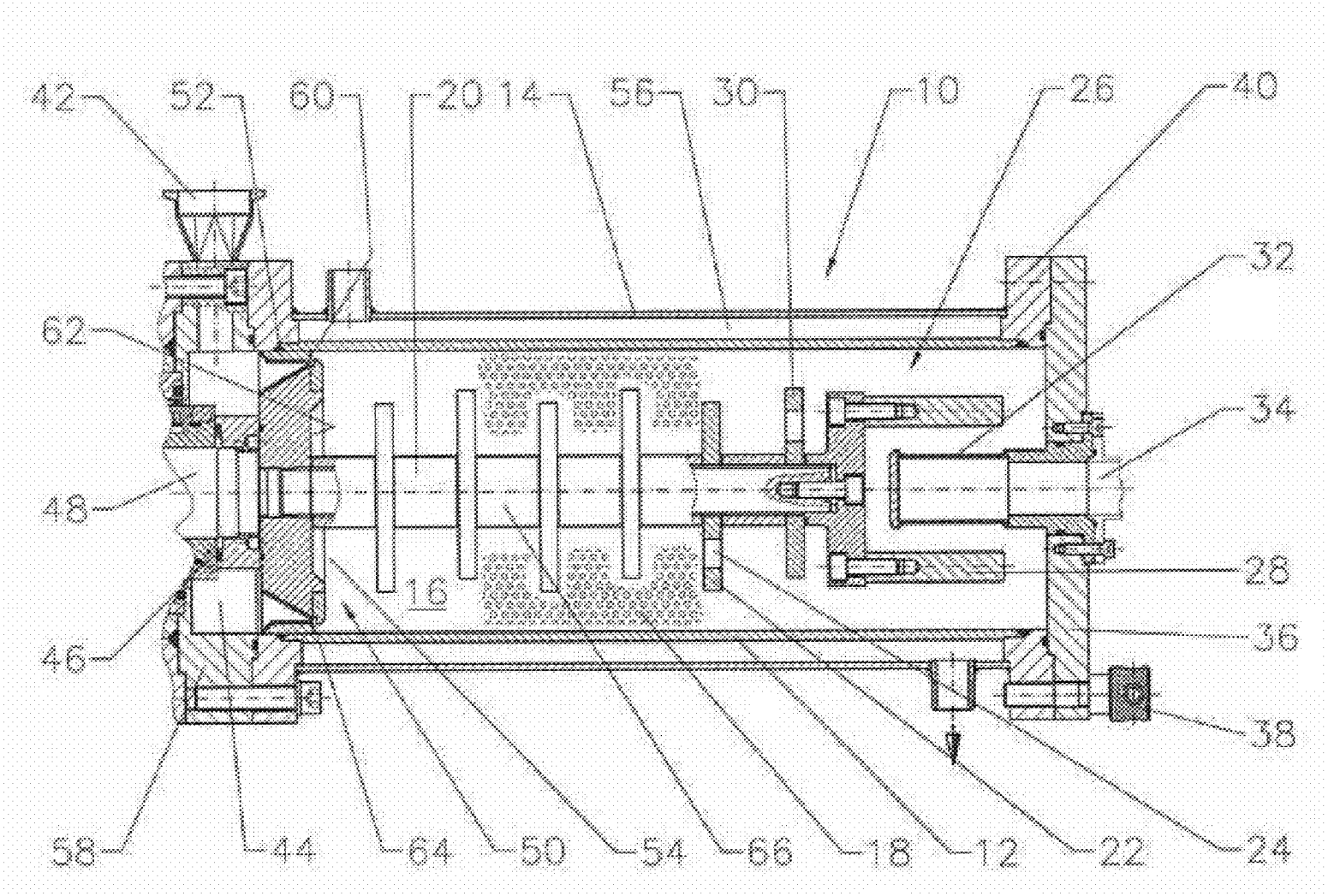
FIG. 1 illustrates an agitating ball mill with pre-crusher.

FIG. 1 shows an agitating ball mill 10 with a comminution vessel 12 which is surrounded by a cooling jacket 14. Comminution media 18 is located in the comminution chamber 16 which is purely shown in a certain region of the comminution chamber for demonstration. In the comminution chamber itself is located the agitating shaft 20 on which the comminution discs 22 with holes 24 are placed. The agitating shaft is put into rotation by a drive which is not shown. To separate the comminution media 18 from the product which is introduced into the comminution chamber, a pre-classifier 26 which can consist of a cage-like construction with a plurality of bars 28 and at least one disc 30 arranged at a close distance to the cage and provided with holes is seated at the free end of the agitating shaft 20. In the exemplary embodiment of FIG. 1 a separating device in form of a screen 32 is arranged downstream of the pre-classifier in terms of flow.

The product leaves the comminution chamber through the outlet 34 which is centrally arranged in the comminution vessel base 36. The comminution vessel base itself is joined through screws 38 with a comminution vessel flange 40. Through the product inlet 42 the product reaches the inlet chamber 44 which adjoins the seal 46 which in turn sits on the drive shaft 48. From the inlet chamber the product reaches the pre-crushing device 50 which is composed of a stationary part 52 and a rotating part 54. The stationary part 52 overlaps both the coolant channel 56 as well as the comminution vessel lid 58. In a modified configuration of the invention the stationary and thus also the rotating part of the pre-crushing device can be displaced in the direction of the comminution chamber so that the stationary ring can be more intensively temperature-controlled through the coolant flowing in the coolant channel. The surface 60 of the stationary part and the surface 62 of the rotating part directed to the comminution chamber form the inlet-sided comminution chamber limit. The ring-shaped comminution gap has a width of 0.2-2 mm.

Figure 2:
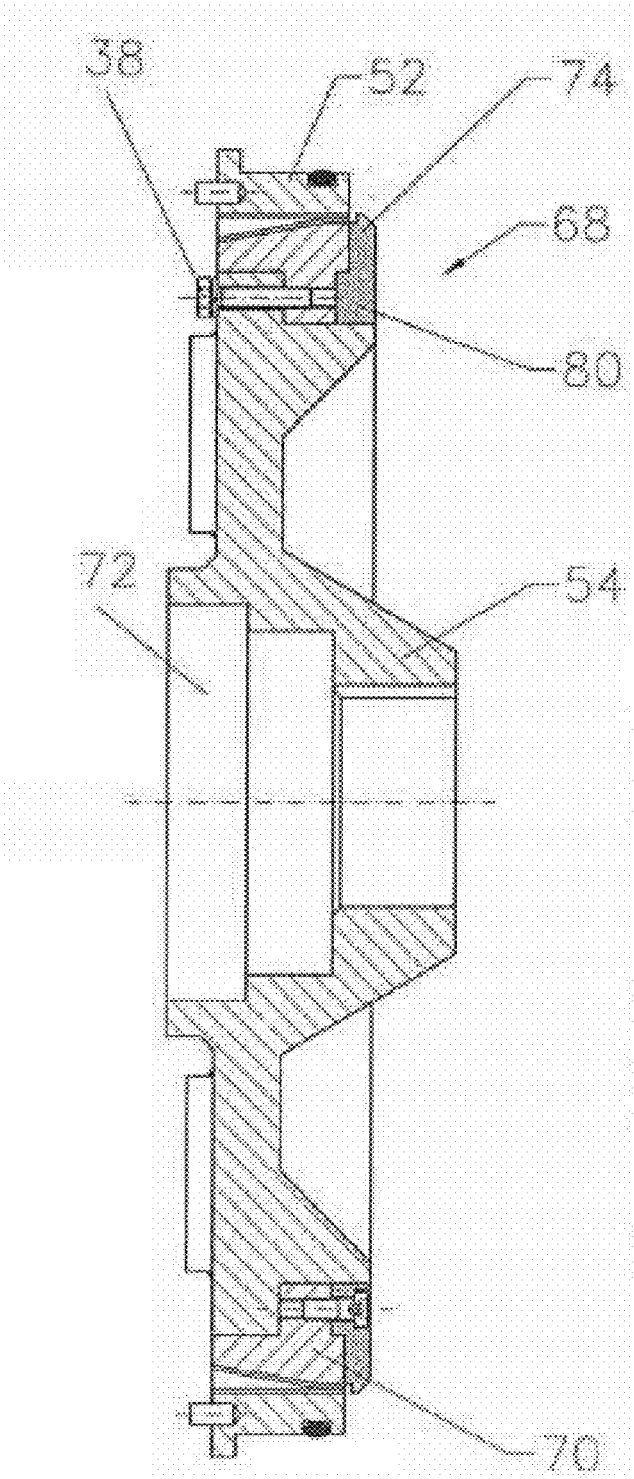
FIG. 2 illustrates a sectional representation of the rotating and stationary part of the pre-crusher.

From FIG. 2 the arrangement of a dynamic gap guard 68, which is designed as ring element 80, is evident. The gap guard 68, meaning the ring element 80, is connected via screws 38 both with the rotating toothed disc 70 as well as with the rotating part 54 of a hub. The hub has central bores 72 by means of which it is attached to the agitating shaft 20.

Figure 3:
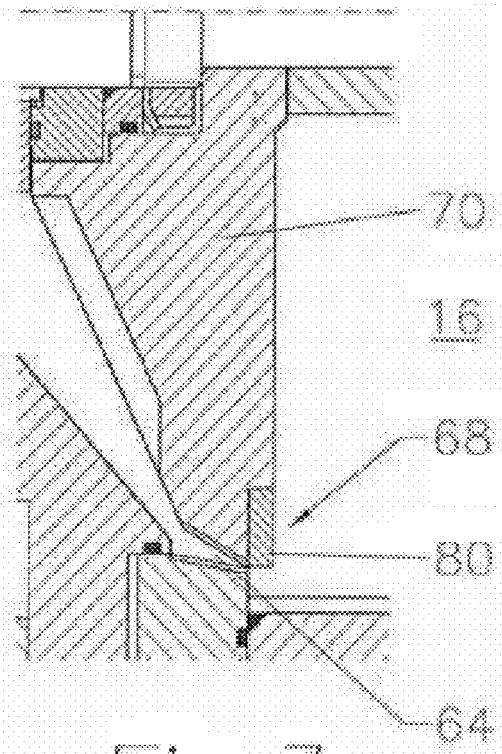
FIG. 3 illustrates a part view of the rotating part.

FIG. 3 shows the arrangement of a gap guard 68 which only adjoins the comminution gap. Its ring element 80 consists of wear-resistant material such as ceramic, high-alloy steel or the like. The ring element 80 in this embodiment does not overlap the gap. Here, the proximity of the rotating part 70 to the comminution gap and if applicable the generated radial flow is sufficient to keep the comminution gap 64 free of comminution media where it meets the comminution chamber 16.

Figure 4:
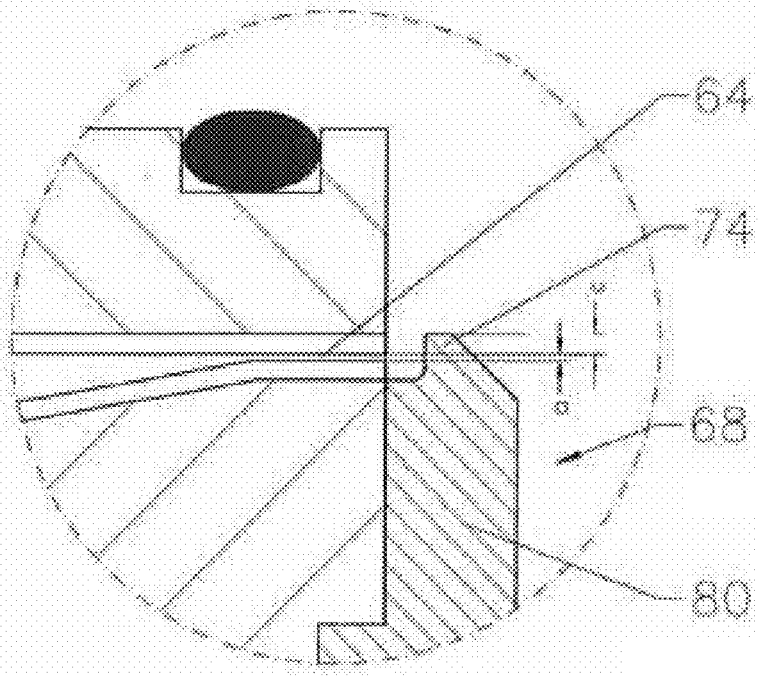
FIG. 4 illustrates a detail of the crushing gap.
Figure 5:
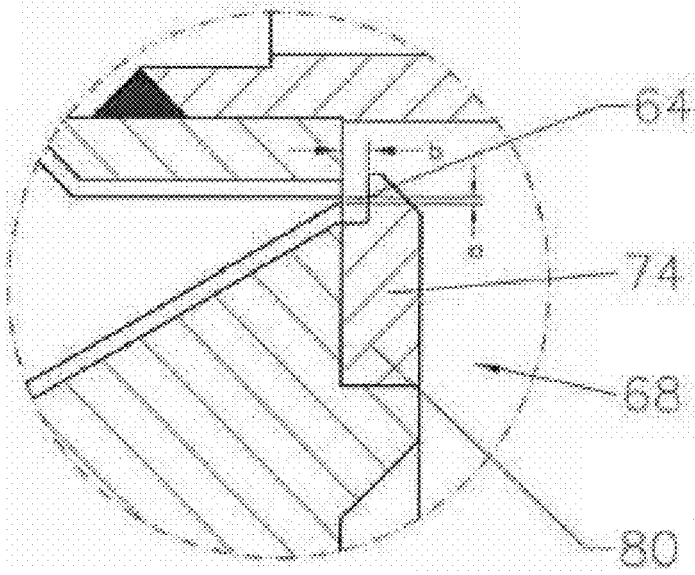
FIG. 5 illustrates a detail of the crushing gap.

Exemplary embodiments are explained according to FIG. 4 and FIG. 5 which show the preferred spacings of the shoulder 74 both radially and axially to the comminution gap 64 and its width a. Accordingly, the ratio of the width a of the comminution gap 64 to the radial overlap c through the shoulder is 1:3. The axial spacing b of the shoulder 74 to the end of the comminution gap 64 compared with the width a of the comminution gap 64 has a ratio of 1:4. This spacing ratio allows resistanceless entry of the pre-crushed product in the comminution chamber 16 since the shoulder 74 or its surface located opposite the comminution gap 64 does not inhibit the inflow.

The shoulder 74 of the gap guard 68 in this exemplary embodiment presents itself as wedge or nose-shaped shoulder. The bevel prevents the wear on the circumference of the ring element 80 and minimises turbulences.

Figure 6:
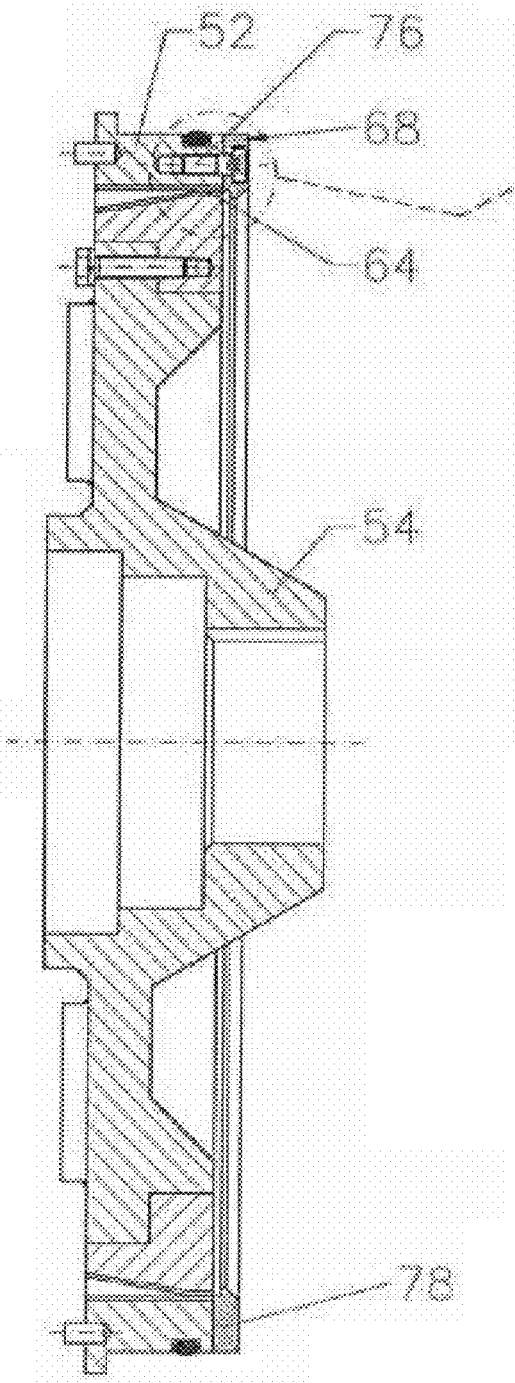
FIG. 6 illustrates a lateral view of the pre-crusher.
Figure 7:
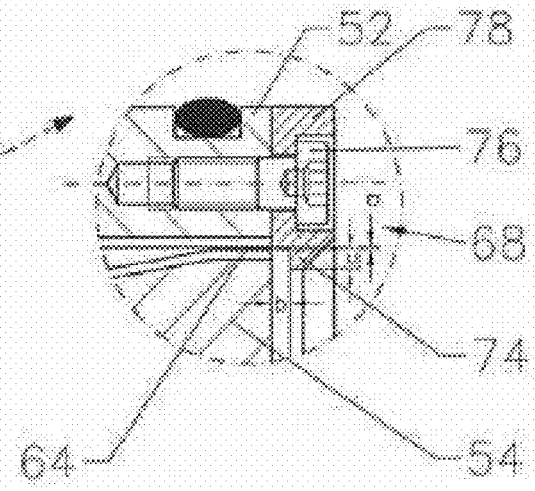
FIG. 7 illustrates a detail of the pre-crusher.

FIGS. 6 and 7 show an embodiment version wherein the gap guard 68 does not operate dynamically but statically. To this end, the ring element 78 of the gap guard 68 bears against the stationary part 52 of the pre-crushing device 50 and is fixed by screws 76. The radially inner side of the ring element 78 overlapping the comminution gap 64 is designed wedge or nose-shaped. In the region of the end of the comminution gap 64 facing to the comminution chamber 16 the wedge or nose-shaped shoulder 74 is arranged at a distance b to the rotating part 54 of the pre-crushing device. The ratio of the radial overlap c of the shoulder 74 beyond the comminution gap 64 into the region of the rotating bar part compared with the width a of the comminution gap is approximately 10:1.

What is claimed is:

1. An agitating ball mill comprising:

an agitating shaft;

a comminution vessel, the comminution vessel surrounding the agitating shaft, the agitating shaft being arranged within the comminution vessel and being parallel to a longitudinal axis of the comminution vessel;

a comminution chamber;

a product inlet and a product outlet; and a pre-crushing device arranged downstream of the product inlet and upstream of the comminution chamber;

wherein an end of a comminution gap on a comminution chamber side is overlapped by a static or dynamic gap guard, wherein the gap guard is connected with a rotating part or stationary part of the pre-crushing device, and wherein the gap guard overlaps the comminution gap in a ratio of 2 to 10 times the width of the comminution gap.

2. The agitating ball mill of claim 1, wherein the gap guard is designed as a ring element.

3. The agitating ball mill of claim 2, wherein the rotating or statically arranged ring element in the region of the comminution gap comprises a wedge-shaped shoulder whose thickness is reduced relative to a thickness of the ring element.

4. The agitating ball mill of claim 3, wherein the shoulder overlaps the comminution gap by 2 to 10 times a width of the comminution gap.

5. The agitating ball mill of claim 3, wherein the material shoulder is arranged with an axial distance to an end of the comminution gap of 2 to 10 times a width of the comminution gap.

6. The agitating ball mill of claim 1, wherein the rotating part is connected with the agitating shaft.

7. The agitating ball mill of claim 1, wherein the stationary part is in connection with the comminution vessel.

8. The agitating ball mill of claim 6, wherein the rotating part consists of a toothed disc.

9. The agitating ball mill according to claim 8, wherein the toothed disc is conically shaped and has teeth arranged on a cone surface.

10. The agitating ball mill of claim 1, wherein at least one of the rotating and the stationary part of the pre-crushing device is provided with conical working surfaces.

11. The agitating ball mill of claim 10, wherein the comminution gap of the pre-crushing device reduces in a direction of the comminution chamber.

12. The agitating ball mill according to claim 1, wherein the comminution gap formed by the stationary part and the rotating part facing the comminution chamber has a width of 0.2-2 mm.

13. The agitating ball mill of claim 1, wherein the stationary part of the pre-crushing device is at least partially arranged in a region of cooling for the comminution vessel.

14. The agitating ball mill of claim 1, wherein both the rotating and also the stationary part of the pre-crushing device are axially adjustable, through which a gap width of the comminution gap during, before or after a production process can be changed, wherein the rotating part is moved on the agitating shaft in axial direction via a thread and at least one of the stationary and the rotating part of the pre-crushing device can be moved through electrical or hydraulic actuators.

15. The agitating ball mill of claim 1, further comprising a separating device which holds back comminution media in the comminution chamber.

* * * * *